US005275551A

United States Patent [19]

Ejiri et al.

[11] Patent Number: 5,275,551

[45] Date of Patent: Jan. 4, 1994

[54] COMBUSTION CHAMBER OF PULSE COMBUSTION APPARATUS

[76] Inventors: Susumu Ejiri; Makoto Kimura, both of Momozono No. 6-23 Mizuho-ku, Nagoya, Japan

[21] Appl. No.: 960,988

[22] Filed: Oct. 14, 1992

[30] Foreign Application Priority Data

Oct. 18, 1991 [JP] Japan ..... 3-093719[U]

[51] Int. Cl.[5] ..... F23C 11/04

[52] U.S. Cl. ..... 431/1; 431/264

[58] Field of Search ..... 431/1, 264; 60/39.76, 60/39.77; 122/24; 432/58

[56] References Cited

U.S. PATENT DOCUMENTS 3,276,505 10/1966 Huber et al. ..... 431/1
4,780,076 10/1988 Davis ..... 431/1
5,020,987 6/1991 Ishiguro et al. ..... 431/1

*Primary Examiner*—James C. Yeung
*Attorney, Agent, or Firm*—Jordan and Hamburg

[57] ABSTRACT

In order to obtain good efficiency of a pulse combustion apparatus, an ignition plug is protected to extend the life span by way of discharging high heat from the plug top in good balance to the combustion chamber, in which a structure of the chamber wall is reformed with respect to the partial wall for receiving the plug screwed therein.

4 Claims, 2 Drawing Sheets

COMBUSTION CHAMBER OF PULSE COMBUSTION APPARATUS

BACKGROUND OF THE INVENTION

1. Field of the Invention

This invention relates to a pulse combustion apparatus in which pulsating explosive combustions occur repeatedly and continuously. A pulse combustion apparatus performs repeatedly explosive combustions in a certain cycle by making use of self-ignition and natural suction of air for combustion at the time or regular combustion, at which combustion heat is used to be applied for cooking devices and the like.

2. Description of the Prior Art

One example of a combustion chamber of this pulse combustion apparatus is shown in FIG. 2. A combustion chamber R in which explosive combustions are performed is generally formed and sectioned by a wall W having a curved face of a snail or a cylindrical shape or the like with a fundamental curvature owing to the characterization of pulse combustion and so on. And as an ignition device necessary at the start of combustion, an ignition plug P is set and inserted into the curved wall W spirally by the screw part P1. Also, TP in FIG. 2 is a tail pipe for the discharge of combustion exhaust.

SUMMARY OF THE INVENTION

As the temperature inside the combustion chamber R of such pulse combustion apparatus becomes, however, very high, the top (L letter-shape part shown by the broken line) of the ground electrode P2 on the ignition plug P often burns or is damaged as shown in FIG. 2. Also the central electrode P3 expands due to high temperature and oxidization, and the surrounding insulator P4 may break up to cut the wire inside.

An object of the present invention is to provide an apparatus in which the above problem may be resolved and to extend the life span of the ignition plug by more efficient radiation of heat from the ignition plug to the outside through the combustion chamber.

This invention is thus summarized as a combustion chamber of pulse combustion apparatus which is formed by a curved faced wall into which is set an ignition plug whose sparks start pulsating explosive combustions in the combustion chamber, and that, in the combustion chamber, the inner face of the wall section where the ignition plug is set and inserted into is furthermore formed with respect to the continuous curved face with a fundamental curvature, to a nearly flat face almost perpendicular to the axis of the ignition plug by increasing the wall thickness inwardly of the chamber.

In the combustion chamber of the pulse combustion apparatus according to the above structure of this invention, the heat of ignition plug heated up during combustion is well radiated by equal transmission through its wall, because the inner face of the wall where the ignition plug is set and inserted is formed to a nearly flat face almost perpendicular to the axis of the ignition plug. In the prior apparatus, an ignition plug is set and inserted generally slantwise to the wall face and furthermore due to the curved face the contact area between the ignition plug and the receiving wall is not constant around its plug. That is, as shown by letter A in FIG. 2, the plug is to have partially an exposed part to the combustion chamber. Compared to this, in the combustion chamber of this invention constant contact with the receiving wall is achieved because the inner face of the same wall is formed approximately perpendicular to the axis of the ignition plug. As a result, radiation of heat from the ignition plug to the combustion chamber wall becomes well without partial deviation.

In order to clarify further the structure and function of this invention in the above, the combustion chamber of the pulse combustion of this invention is explained as below by way of a suitable practical example.

DETAILED DESCRIPTION OF THE PREFERRED EMBODIMENT

Figure 1:
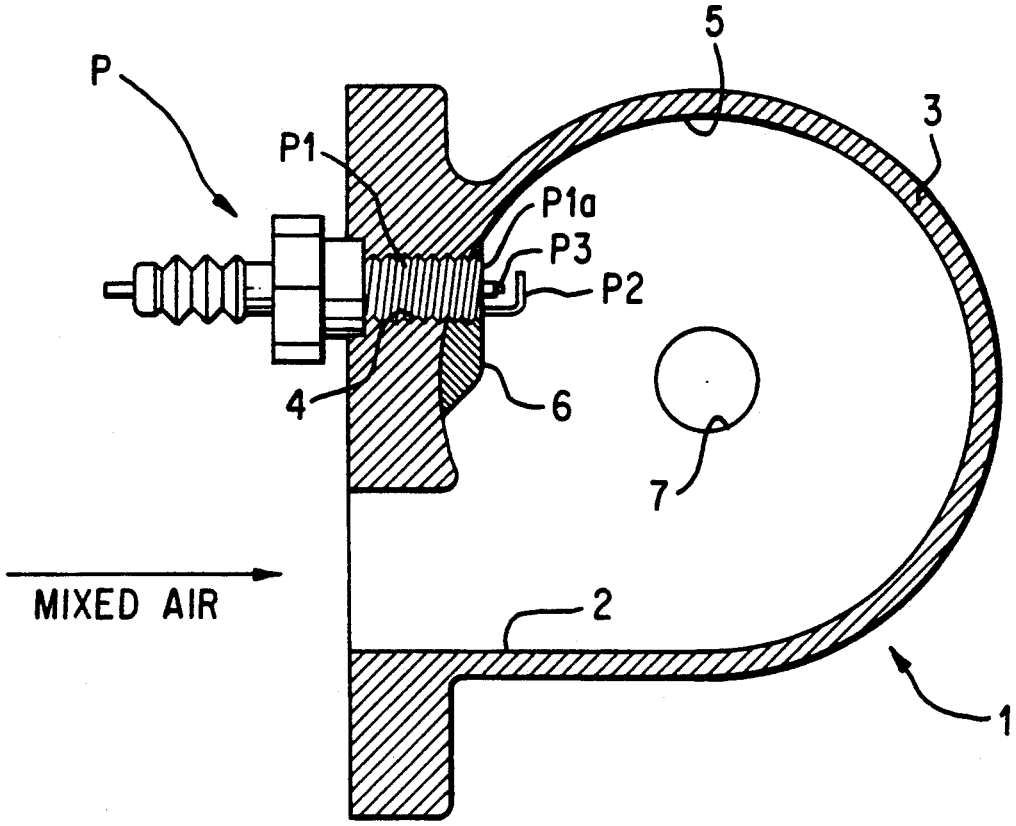
FIG. 1 is a sectional elevational view of a combustion chamber of the pulse combustion apparatus as a practical example of this invention.

FIG. 1 is a schematic cross-sectional diagram of a combustion chamber used in a pulse combustion apparatus as a practical example. The combustion chamber 1 is a chamber where mixed air is drawn in from a mixing chamber not shown in FIG. 1 and at a certain cycle explosive combustions are continuouly repeated, and the shape is formed like snail to possess a cave of almost circular in cross section. The entrance 2 of the combustion chamber which is connected with the mixing chamber not shown in FIG. 1, is formed toward a tangent of the combustion chamber 1 in order to take in mixed air well and also to prevent backfire.

In the wall 3 composing the combustion chamber 1, a screw hole 4 for installing an ignition plug (hereinafter called as plug fitting hole 4) is provided and into this hole a plug P is fitted and inserted by screwing. Also the inner wall face where the plug fitting hole 4 is made is formed with a flat wall perpendicular to the inserting direction of the plug P. In other words, with respect to the continuous curved face 5 forming a snail's shape, the inner wall face where the ignition plug is set is formed to be perpendicular to the axis of the ignition plug by increasing the wall thickness. This part of the inner wall face is hereinafter called an inner plane 6. Furthermore in FIG. 1 for easy understanding, hatching is placed respectively on the wall forming inner plane 6 around the plug fitting hole 4 and on the wall forming the other curved face 5. However, they are one body. Also numeral 7 in FIG. 1 indicates a tail pipe to discharge the exhausting air after combustion and which is set up in bothside faces of combustion chamber 1.

The ignition plug P in whose top is set a central electrode P3 and a ground electrode P2 bent in the form of the letter L and in whose central side face is set a cylindrical screw part P1, is fitted and inserted by screwing the screw part P1 into the plug fitting hole 4. Consequently, a ring-form face P1a of the edge of screw part P1 becomes parallel to the inner plane 6, and besides in this practical example the inserting position is set so that both of these faces are approximately in one plane. Also not shown in the drawings is a flame rod for flame detection and which is set next to the ignition plug and inserted perpendicularly on the wall forming the above inner plane 6.

In the combustion chamber 1 constructed as above, after the ignition by the ignition plug P, explosive combustions are repeated in a certain cycle and the internal temperature becomes very high. However, for the reasons mentioned below the life span of ground electrode P2 and central electrode P3 of the ignition plug can be extended. That is, as heat from the ground electrode P2 and central electrode P3 whose temperature have become high by the effect of pulse combustion is transmitted via the screw par P1 uniformly to the wall 3 of combustion chamber 1, the heat radiation effect can be increased without deviation.

Figure 2:
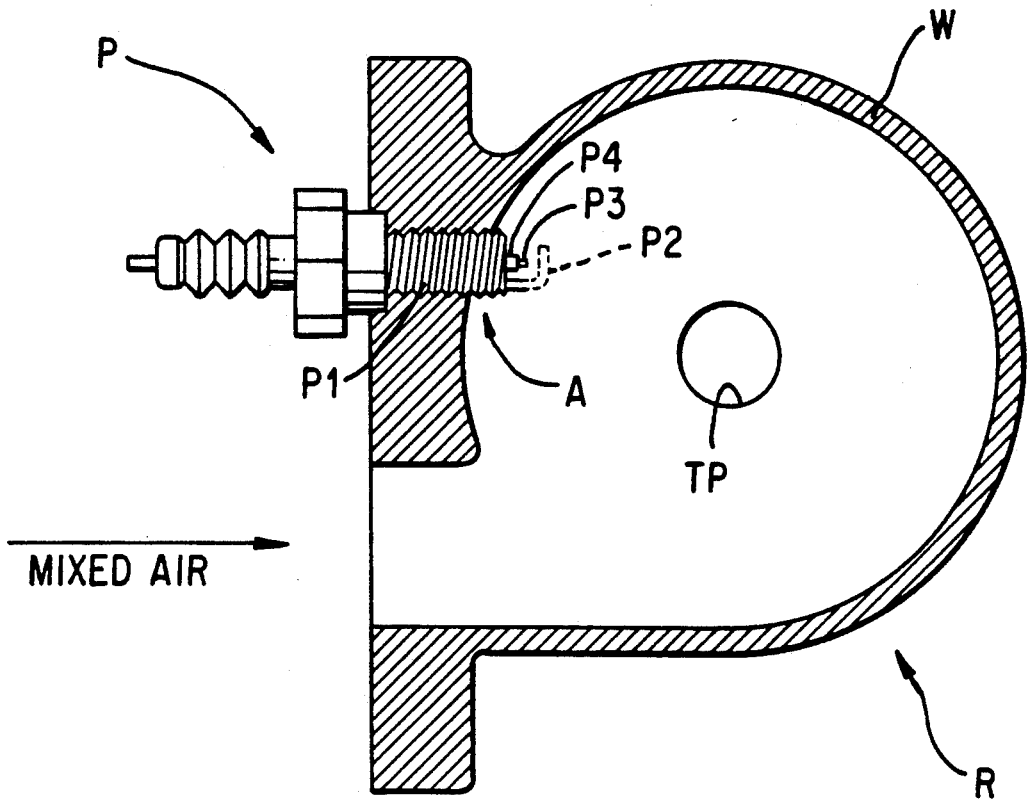
FIG. 2 PRIOR ART
FIG. 2 is a sectional elevational view of a prior art arrangement.

In conventional device as shown in FIG. 2, the effective heat radiation can not be achieved because a part of the screw part P1 is exposed in the combustion chamber R (shown at A in FIG. 2), by the fact that the ignition plug P is inserted and set in the curved wall W. Furthermore, in this example, the inclined set up of the ignition plug also affects such partial exposure. If the exposure of screw part P1 is prevented by setting the ignition plug drawn outwards from the combustion chamber R, the position of both electrodes P2 and P3 will become far from the center of the chamber R to result in decrease of the ignition efficiency.

Compared to this, in the combustion chamber 1 of the practical example, the radiation effect of the screw part P1 can be obtained at its maximum for the face of the inner wall part where the ignition plug P is fixed by insertion is formed as perpendicular to the axis of the plug. Consequently, the breakage of ground electrode P2, the wire of central electrode P3 or others due to combustion heat can be reduced so that the life span of the ignition plug P is extended.

The temperature which reaches 900° C. at the plug top of the prior art can be reduced to 840° C. and further to 700° C. by effect of the increasing wall thickness to make the flat face 6 continuous from the fundamental curve 5 of the pulse combustion chamber.

This invention explained with the above practical example is not limited by such practical example and of course can be practiced within the limits without deviating from the major points of the invention.

What is claimed is:

1. A combustion chamber for a pulse combustion apparatus in which an ignition plug is mounted to provide sparking for pulsating explosive combustion in the combustion chamber, said combustion chamber comprising a combustion chamber structure having a curved inner wall, said structure having a wall thickness, an ignition plug mounting section on said structure for mounting said ignition plug, said ignition plug having an axis, said ignition plug mounting section comprising a thickening portion which increases said wall thickness inwardly of said curved inner wall to form a flat inner wall surface in said combustion chamber, said surface inner wall surface being substantially perpendicular to said axis of said ignition plug.

2. A combustion chamber according to claim 1 wherein said combustion chamber has a central axis, said curved inner wall being a substantially cylindrical wall having a cylindrical axis coincident with said central axis, said ignition plug axis being perpendicular to said central axis.

3. A combustion chamber according to claim 2 wherein said combustion chamber has inlet means opening up into said curved inner wall, said inlet means comprising a passage having a longitudinal axis disposed generally tangentially to said central axis.

4. A combustion chamber according to claim 2 wherein said combustion chamber has discharge means comprising a passage having a longitudinal axis coincident with said central axis.

* * * * *